US006932701B2

(12) United States Patent
Glavich et al.

(10) Patent No.: US 6,932,701 B2
(45) **Date of Patent: *Aug. 23, 2005**

(54) GAMING DEVICE HAVING A BONUS SCHEME INCLUDING A PLURALITY OF SELECTION GROUPS WITH WIN-GROUP OUTCOMES

(75) Inventors: Paulina Glavich, Reno, NV (US); Joseph E. Kaminkow, Reno, NV (US)

(73) Assignee: IGT, Reno, NV (US)

( * ) Notice: Subject to any disclaimer, the term of this patent is extended or adjusted under 35 U.S.C. 154(b) by 445 days.

This patent is subject to a terminal disclaimer.

(21) Appl. No.: 09/981,084

(22) Filed: Oct. 15, 2001

(65) Prior Publication Data

US 2002/0045475 A1 Apr. 18, 2002

Related U.S. Application Data

(63) Continuation-in-part of application No. 09/656,702, filed on Sep. 7, 2000, now Pat. No. 6,439,995.

(51) Int. Cl.[7] ..... A63F 9/24

(52) U.S. Cl. ..... 463/20; 463/16; 463/21; 463/1

(58) Field of Search ..... 463/20, 16–21, 463/1, 2, 7, 9–13, 25, 30, 31, 36–38; 273/138.1, 138.2, 139, 236, 237, 242; 283/903

(56) References Cited

U.S. PATENT DOCUMENTS

| | | | |
|---|---|---|---|
| 4,182,515 | A | 1/1980 | Nemeth |
| 4,695,053 | A | 9/1987 | Vazquez, Jr. et al. |
| 5,046,737 | A | 9/1991 | Fienberg |
| 5,449,173 | A | 9/1995 | Thomas et al. |
| 5,611,535 | A | 3/1997 | Tiberio |
| 5,647,798 | A | 7/1997 | Falciglia |
| 5,743,524 | A | 4/1998 | Nannicola |
| 5,788,573 | A | 8/1998 | Baerlocher et al. |

(Continued)

FOREIGN PATENT DOCUMENTS

| | | | | |
|---|---|---|---|---|
| EP | 0874337 A1 | | 10/1998 | |
| EP | 0945837 A2 | | 3/1999 | |
| EP | 0926645 A2 | | 8/1999 | |
| EP | 0984409 A2 | | 3/2000 | |
| GB | 2144644 A | * | 3/1985 | ..... A63F/9/22 |

OTHER PUBLICATIONS

The Canonical List of TPiR Pricing Games, downloaded from the Internet at http://www.chris–lambert.com/PRICE/Pricing_Games.html on Oct. 7, 2003.*

Sphinx Brochure written by Atronic Casino Technology, Ltd., published in 1997.

Spin Til You Win Information Sheet written by IGT, published in 1996.

Run For Your Money Game Brochures (and Description) written by Barcrest, published prior to 2001.

Money to Burn Brochure written by WMS Gaming, Inc., published prior to 2001.

Crazy Fruits Brochure written by Atronic, published prior to 2001.

Top Dollar Brochure written by IGT, published in 1998.

*Primary Examiner*—Chanda L. Harris
*Assistant Examiner*—Jason Skaarup
(74) *Attorney, Agent, or Firm*—Bell, Boyd & Lloyd LLC

(57) ABSTRACT

The present invention relates to a gaming device with a bonus scheme including a plurality of groups of symbols and a plurality of bonus value outcomes and at least one win-group outcome associated with the symbols. The win-group outcome corresponds to a plurality of the bonus value outcomes. A player can select symbols and gain bonus values while advancing from group to group. If a player reaches a win-group outcome, the player receives all of the bonus value outcomes which correspond to the win-group outcome.

37 Claims, 13 Drawing Sheets

U.S. PATENT DOCUMENTS

| | | | |
|---|---|---|---|
| 5,997,400 | A | 12/1999 | Seelig et al. |
| 5,997,401 | A | 12/1999 | Crawford |
| 6,004,207 | A | 12/1999 | Wilson, Jr. et al. |
| 6,015,346 | A | 1/2000 | Bennett |
| 6,016,338 | A | 1/2000 | Bansal et al. |
| 6,033,307 | A | 3/2000 | Vancura |
| 6,045,129 | A | 4/2000 | Cooper et al. |
| 6,059,289 | A | 5/2000 | Vancura |
| 6,089,976 | A | 7/2000 | Schneider et al. |
| 6,089,977 | A | 7/2000 | Bennett |
| 6,093,102 | A | 7/2000 | Bennett |
| 6,102,798 | A | 8/2000 | Bennett |
| 6,120,031 | A | 9/2000 | Adams |
| 6,126,542 | A | 10/2000 | Fier |
| 6,149,156 | A | 11/2000 | Feola |
| 6,159,097 | A | 12/2000 | Gura |
| 6,159,098 | A | 12/2000 | Slomiany et al. |
| 6,165,070 | A | 12/2000 | Nolte et al. |
| 6,174,235 | B1 | 1/2001 | Walker et al. |
| 6,186,894 | B1 | 2/2001 | Mayeroff |
| 6,190,254 | B1 | 2/2001 | Bennett |
| 6,190,255 | B1 | 2/2001 | Thomas et al. |
| 6,224,483 | B1 | 5/2001 | Mayeroff |
| 6,231,445 | B1 | 5/2001 | Acres |
| 6,270,409 | B1 | 8/2001 | Shuster |
| 6,315,664 | B1 | 11/2001 | Baerlocher et al. |
| 6,609,971 | B2 | 8/2003 | Vancura |

* cited by examiner

GAMING DEVICE HAVING A BONUS SCHEME INCLUDING A PLURALITY OF SELECTION GROUPS WITH WIN-GROUP OUTCOMES

PRIORITY CLAIM

This application claims priority of and is a continuation-in-part application of U.S. patent application Ser. No. 09/656,702, filed on Sep. 7, 2000 now U.S. Pat. No. 6,439,995, entitled "GAMING DEVICE HAVING A BONUS SCHEME WITH MULTIPLE SELECTION GROUPS."

CROSS-REFERENCE TO RELATED APPLICATION

This application is related to the following commonly-owned co-pending patent applications: "GAMING DEVICE HAVING A BONUS SCHEME WITH MULTIPLE SELECTION GROUPS," Ser. No. 09/656,702, "GAMING DEVICE HAVING MULTIPLE AWARD ENHANCING LEVELS," Ser. No. 09/626,720, "GAMING DEVICE WITH PRIZE BONUS SCHEME HAVING MULTIPLE AWARD LEVELS," Ser. No. 09/602,140, "GAMING DEVICE HAVING A MULTIPLE SELECTION GROUP BONUS ROUND," Ser. No. 09/605,107, "GAMING DEVICE HAVING A MULTIPLE SCREEN BONUS ROUND," Ser. No. 09/629,235, "GAMING DEVICE HAVING DIRECTIONAL BONUS SCHEME," Ser. No. 09/679,499, "GAMING DEVICE HAVING APPARATUS AND METHOD FOR PRODUCING AN AWARD THROUGH AWARD ELIMINATION OR REPLACEMENT," Ser. No. 09/686,283, "GAMING DEVICE HAVING AN AWARD EXCHANGE BONUS ROUND AND METHOD FOR REVEALING AWARD EXCHANGE POSSIBILITIES," Ser. No. 09/689,510, "GAMING DEVICE HAVING A MULTI-ROUND BONUS SCHEME WHEREIN EACH ROUND HAS A PROBABILITY OF SUCCESS," Ser. No. 09/688,441, "GAMING DEVICE HAVING MULTIPLE CHOICE LARGE AWARD BONUS SCHEME," Ser. No. 09/686,284, "GAMING DEVICE HAVING A MULTIPLE SELECTION SET BONUS SCHEME," Ser. No. 09/680,592, "GAMING DEVICE HAVING RELATED MULTI-GAME BONUS SCHEME," Ser. No. 09/688,972, "GAMING DEVICE WITH A BONUS SCHEME HAVING REPEATED SELECTION OF VALUE SETS WITH OPTION TO SAVE VALUES," Ser. No. 09/684,533, "GAMING DEVICE HAVING A MULTIPLE SELECTION AND AWARD DISTRIBUTION BONUS SCHEME," Ser. No. 09/688,635, "GAMING DEVICE HAVING AN ELEMENT AND ELEMENT GROUP SELECTION AND ELIMINATION BONUS SCHEME," Ser. No. 09/689,381, and "GAMING DEVICE HAVING IMPROVED OFFER AND ACCEPTANCE BONUS SCHEME," Ser. No. 09/680,630.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device including a plurality of selection groups with win-group outcomes.

BACKGROUND OF THE INVENTION

Current gaming machines, such as slot machines, video poker machines, video blackjack machines and video keno machines, have bonus schemes wherein players are able to receive various awards associated with various events in a bonus game. For example, a player may receive a relatively high bonus value for selecting a certain symbol and a relatively low bonus value for selecting another symbol. The gaming device processor generates the outcomes for the player, such as bonus value outcomes and game termination outcomes There are no known gaming devices which include a bonus scheme having a plurality of selection groups with win-group outcomes which provide a player with a plurality of bonus values in a group after a player selects a predetermined symbol in that group, which enables a player to only select one symbol in each group, which includes terminators in one or more of the groups, and wherein the player advances from group to group to gain bonus values and obtain an additional or supplemental award for advancing through each group without selecting a terminator. To increase player enjoyment and excitement, it is desirable to provide players with gaming devices having new bonus schemes.

SUMMARY OF THE INVENTION

One embodiment of the gaming device of the present invention provides a bonus game including a plurality of groups of symbols displayed to a player. Each group of symbols includes a plurality of selectable symbols or selections. Predetermined or preferably randomly determined outcomes are associated with each of the selectable symbols. In one embodiment, the gaming device processor operates in accordance with a predetermined program to generate predetermined outcomes and associate the outcomes with the symbols either at the beginning of the bonus game or each time a player selects a symbol.

The potential outcomes associated with the symbols in one preferred embodiment include bonus value outcomes, group-win outcomes and termination outcomes. On one preferred embodiment, the player is only allowed to pick one symbol in each group. If a player picks a symbol in a group having a bonus value outcome, the gaming device provides the player with a predetermined bonus value of that outcome and preferably displays this bonus value to the player in place of the selected symbol. The win-group outcome corresponds to or is associated with a plurality of the bonus value outcomes. In one embodiment, the bonus value outcomes which correspond to the win-group outcome are all associated with symbols in the same group. Thus, if a player picks a symbol having a win-group outcome in a particular group, the gaming device provides the player with a plurality of the bonus values outcomes associated with the win-group outcome. For example, a group may have five symbols including four value outcomes and one win-group outcome. If the player picks the symbol associated with the win-group outcome, the gaming device may provide the player with the four values associated with the other symbols.

In one embodiment, the win-group outcome in a group is associated with all of the bonus value outcomes in that group. As such, when a player reaches a win-group outcome, the player receives all of the bonus values resulting from all of the bonus value outcomes in that group. Here, the win-group outcome functions as a win-all outcome, awarding a player with all of the bonus values available in a group. In the previous example, in this embodiment when the player chose the symbol associated with the win-group outcome, the gaming device provides the player with all four of the values associated with the symbols.

It should be understood that the win-group outcome is associated with a plurality of bonus value outcomes which are available to the player. In one alternative embodiment where the player may select more than one symbol in a group, after a player has picked a symbol and received the associated bonus value, the gaming device again makes this bonus value available to the player if the player picks a symbol in that group which is associated with a win-group outcome. In another alternative of this embodiment, once a player picks a symbol associated with a bonus value, the gaming device makes this bonus value unavailable to the player even if the player later picks a symbol in that group which is associated with a win-group outcome. In this embodiment, the win-group outcome functions as a win-remaining outcome because the player only receives values associated with symbols which the player has not already picked.

In the preferred embodiment where the player can make only one selection in each group, when a player reaches a win-group outcome, the processor requires the player to make his/her next selection from a different selection group. This process continues until the player advances through the groups while avoiding termination outcomes. In the preferred embodiment, if the player advances through the last group, the player receives a predetermined or randomly determined additional or supplemental bonus award or achievement bonus value. The bonus game terminates when the player picks a symbol with a terminating condition in any group or if the player receives the achievement bonus value. In one preferred embodiment, the achievement bonus value is relatively higher than any bonus value generated in the selection groups and also higher than the combined bonus values associated with the win-group outcomes.

In another embodiment of the present, the bonus scheme includes one or more separate move outcomes associated with the symbols in each group. If at any time a player obtains a move outcome in one group, the processor requires the player to make his/her next selection from a different group. In this embodiment, every group does not have to have a win-group outcome or a termination outcome associated with a selectable symbol in that group. This alternative embodiment can also include move outcomes which require the player to revisit certain selection groups. For example, a player may advance to a predetermined group, select a symbol and receive a downward move outcome in that group. The player could then be required to make his/her next selection from a predetermined selection group located below the selected symbol's group.

In one further alternative embodiment of the present invention, the bonus scheme includes win-group outcomes which do not advance the player to different groups. Here, when a win-group outcome occurs, the player receives all of the bonus values in the selected symbol's group and the bonus game then terminates. In another alternative embodiment of the present invention, the processor does not reveal bonus values during the bonus game until the player reaches a win-group outcome or a termination outcome.

In another alternative embodiment, the present invention does not include a termination outcome associated with any of the selectable symbols in the selection groups. In this embodiment, the bonus game terminates when a predetermined termination condition occurs, such as the player making a predetermined number of selections of symbols or the player winning a predetermined bonus value amount.

It should be appreciated that when a player reaches a win-group outcome, the processor does not have to display a win-group symbol. Instead, the processor can merely display the various bonus values associated with the win-group outcome. Accordingly, it should be understood that it is preferable, though not necessary, that all of the various outcomes are indicated by various predetermined outcome symbols.

In one embodiment, outcome symbols are used to indicate all of the outcomes. Here, the gaming device's memory stores a plurality of bonus values, win-group symbols and termination symbols. The processor uses a predetermined program to associate the bonus values, the win-group symbols and the termination symbols with the selectable symbols. When the player selects a symbol, the processor reveals, unmasks or otherwise displays the outcome symbol which is associated with the selected symbol.

The gaming device of the present invention, in one embodiment, includes a bonus game which presents a plurality of award groups or selection groups to a player. Bonus value outcomes, group-win outcomes and termination outcomes are associated with the selectable symbols. The processor enables the player to select one symbol in each of the groups, and depending upon which symbol the player selects, the player may reach a bonus value outcome, a win-group outcome or a termination outcome. The player can accumulate bonus values by reaching bonus value outcomes and win-group outcomes while avoiding termination outcomes. When the player reaches a win-group outcome in a group, the player obtains all of the bonus values generated in that group, and the processor requires the player to make his/her next selection from a different group. The player is provided a achievement award if the player does not select any symbols in any group having a termination outcome. This type of gaming device increases the excitement and enjoyment experienced by gaming device players.

It is therefore an advantage of the present invention is to provide a gaming device having a bonus scheme including a plurality of selection groups with win-group outcomes and additional bonus values.

Another advantage of the present invention is to provide a gaming device with a bonus game which enables a player to pick symbols from different selection groups with the possibility of reaching an outcome which provides the player with all of the bonus values available in that group.

Other objects, features and advantages of the invention will be apparent from the following detailed disclosure, taken in conjunction with the accompanying sheets of drawings, or in like numerals referred to like parts, elements, components, steps and processes.

DETAILED DESCRIPTION OF THE INVENTION

Gaming Device and Electronics

Figure 1A:
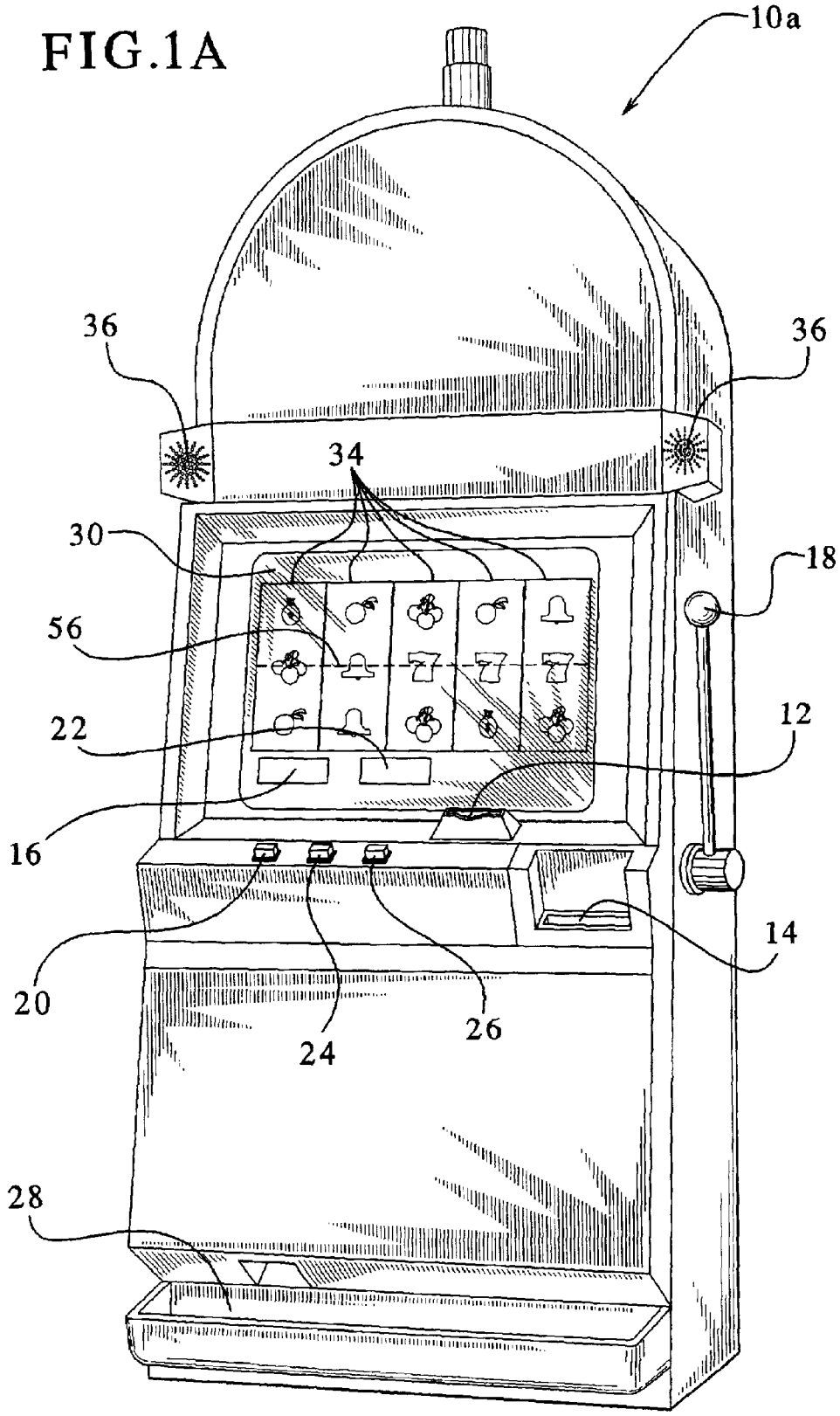
FIG. 1A is a perspective view of one embodiment of the gaming device of the present invention.
Figure 1B:
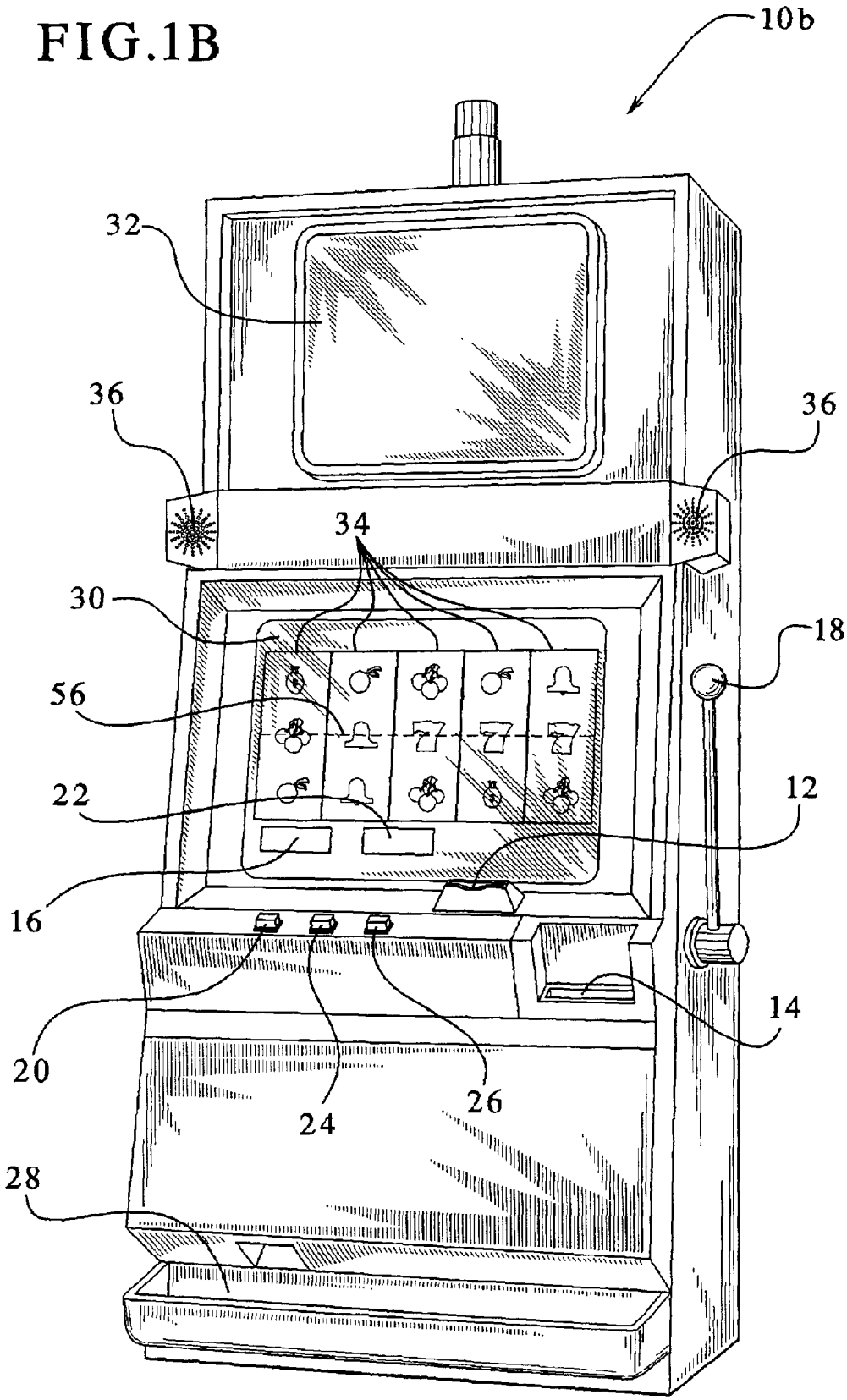
FIG. 1B is a perspective view of another embodiment of the gaming device of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is in one embodiment a slot machine having the controls, displays and features of a conventional slot machine. It is constructed so that a player can operate it while standing or sitting, and gaming device 10 is preferably mounted on or in a console or cabinet. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker, blackjack or keno, any of their bonus triggering events and any of their bonus games. The symbols and indicia used on and in gaming device 10 may be in mechanical, electrical or video form.

As illustrated in FIGS. 1A and 1B, gaming device 10 includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. The gaming device can also include a conventional bet max button (not shown).

A player may "cash out" and thereby receive a number of coins corresponding to the number of remaining credits by pushing a cash out button 26. When the player "cashes out," the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. Gaming device 10 may display a plurality of reels 34, preferably three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia or symbols such as bells, hearts, fruits, numbers, letters, bars or other images which preferably correspond to a theme associated with the gaming device 10. Furthermore, gaming device 10 preferably includes speakers 36 for making sounds or playing music.

Figure 2:
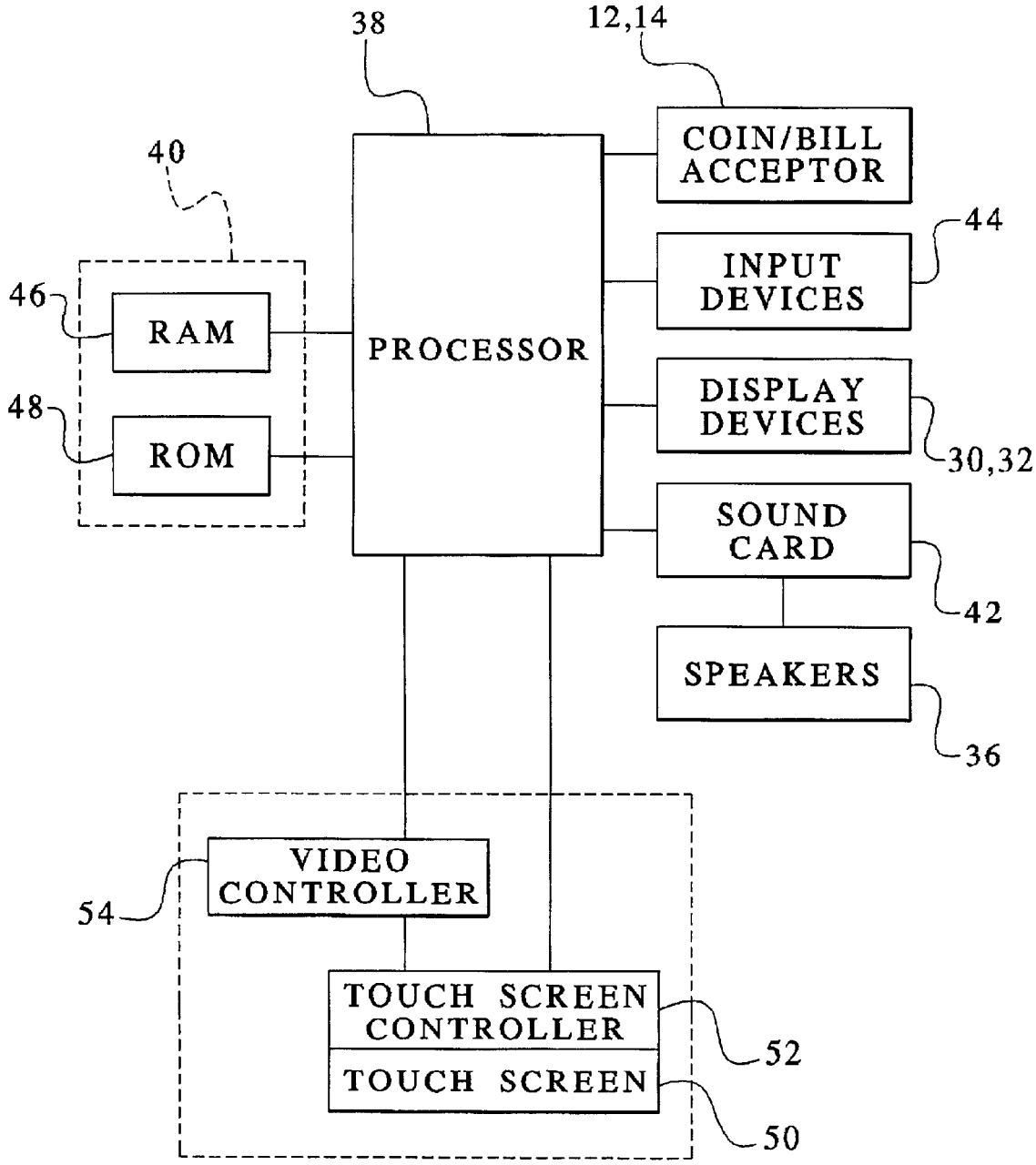
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). The processor may include a sub-processor for controlling certain functions of the gaming device. Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the "computer" or "controller."

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Bonus Scheme

Figure 3:
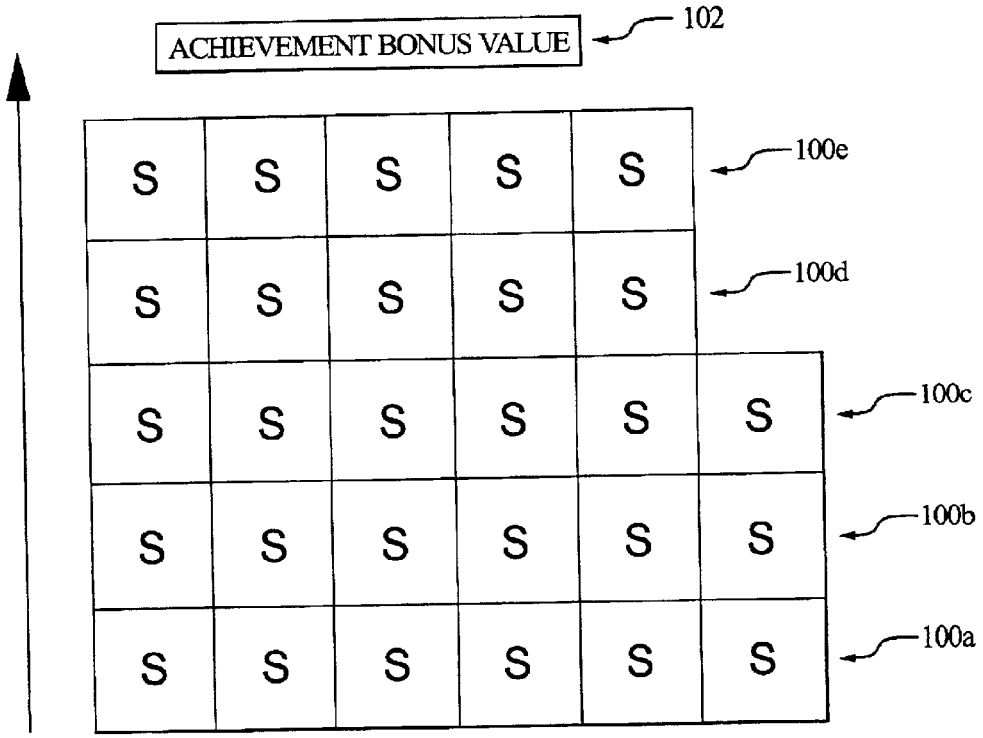
FIG. 3 is a top plan view of the selection groups in one embodiment of the bonus scheme of the present invention.

With reference to FIG. 3, in one embodiment of the gaming device of the present invention, the bonus scheme includes: (a) a plurality of selection groups 100*a* to 100*e;* (b) a plurality of selectable symbols (indicated by the capital letter "S") in each of the selection groups; (c) various bonus value outcomes associated with various symbols; (d) one or more termination outcomes associated with the symbols in each group; (e) one or more win-group outcomes associated with the symbols in each group; and (f) an achievement bonus value 102.

One preferred embodiment of the present invention is illustrated in FIGS. 3A to 3D. The gaming device of this embodiment enables the player to select one choice or selection in each of the groups 100*a* to 100*e*. If the player selects a selection in each group without obtaining or selecting a terminator or a selection having a terminator associated therewith, the processor provides the achievement bonus value 102 to the player.

Figure 3A:
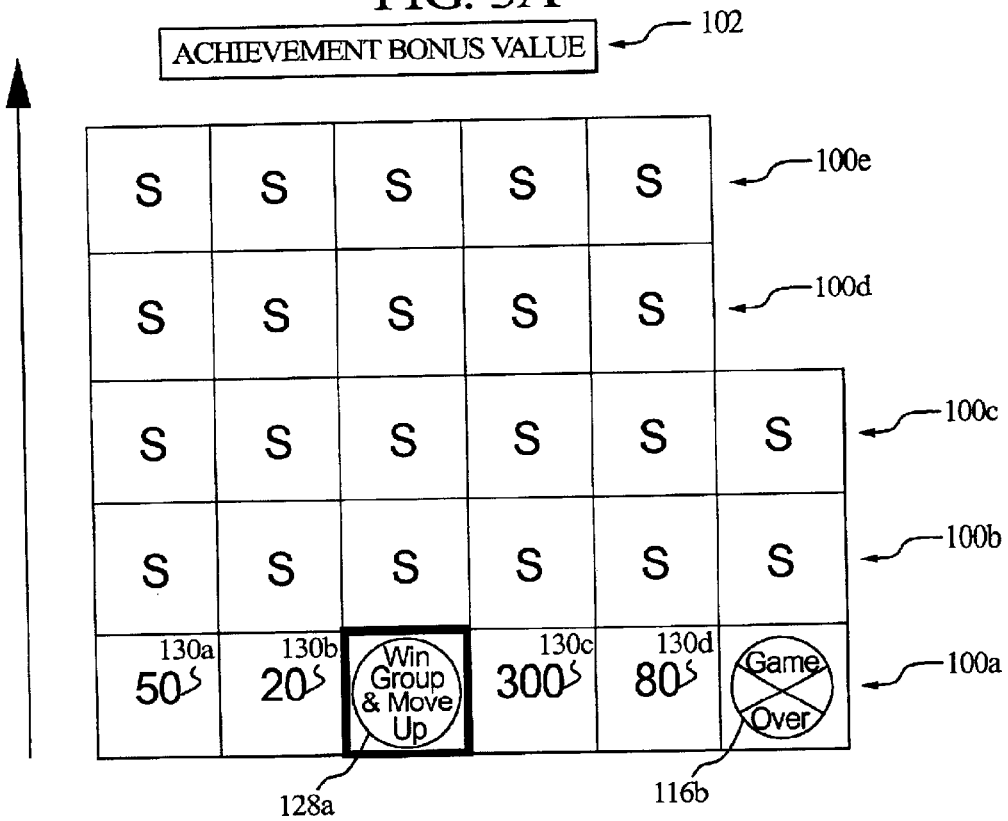
FIGS. 3A to 3D are top plan views of the selection groups in one preferred embodiment of the bonus scheme of the present invention.

In one example game of this embodiment, as illustrated in FIG. 3A, the player's first choice in the first symbol group 100*a* is indicated by the blocked selection and is a win group outcome 128*a*. The win group outcome 128*a* provides all of the other bonus values in the group 100*a* to the player. Accordingly, the player obtains bonus value 130*a* which is 50, bonus value 130*b* which is 20, bonus value 130*c* which is 300 and bonus value 130*d* which is 80. Preferably, the game reveals all of these bonus values to the player as well as the terminator symbol 116*b* which is associated with the remaining selection in selection group 100*a*. The processor than enables the player to select one of the choices or selections in selection group 100*b*. The player selects the selection indicated by the block in FIG. 3B. The processor then reveals the bonus value 130*e* associated with the picked selection which is 250 and provides this bonus value to the player. The processor does not enable or allow the player to pick any of the other selections in selection group 100*b*. This process continues until the player picks a selection in one of the groups having an associated terminator or a selection in each of the groups. If the player picks a selection in each of the groups without obtaining a terminator, as indicated above, the processor provides the achievement bonus value 102 to the player.

Figure 3B:
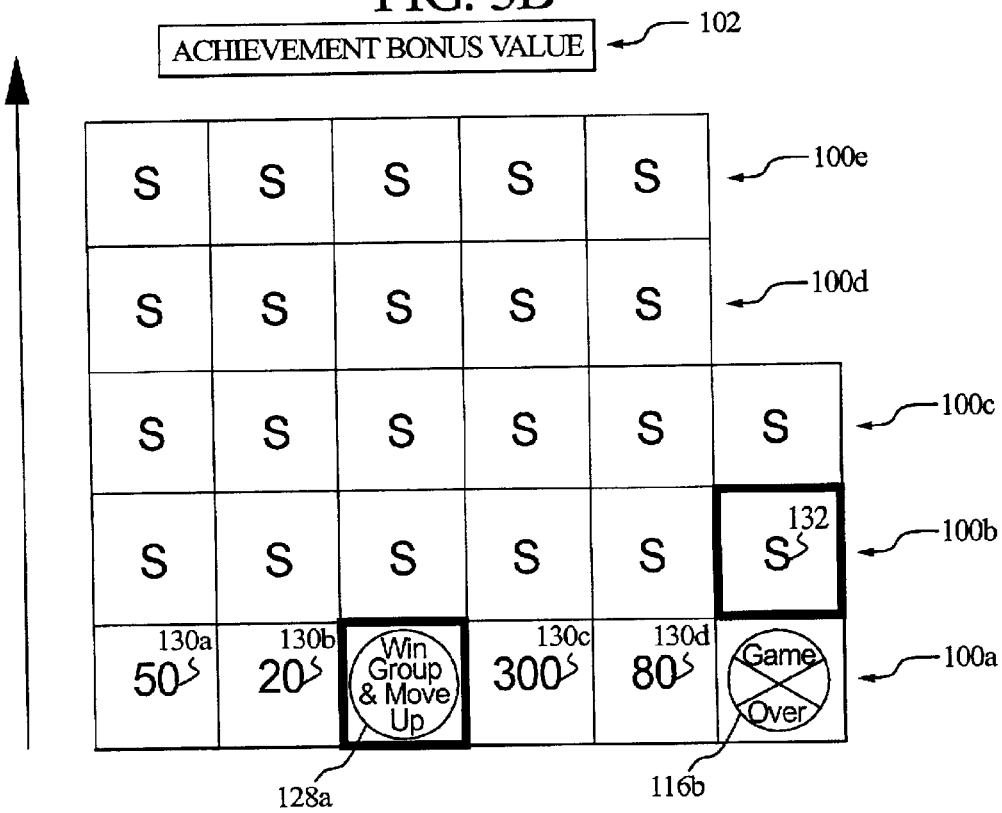
Figure 3C:
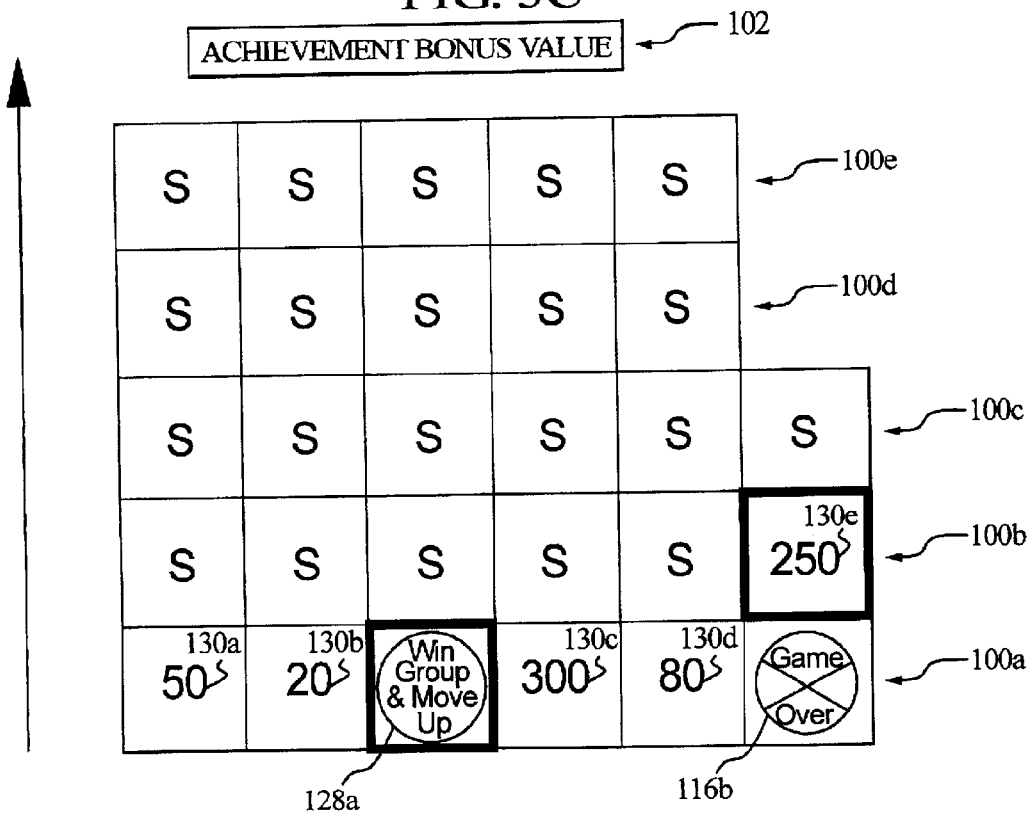
Figure 3D:
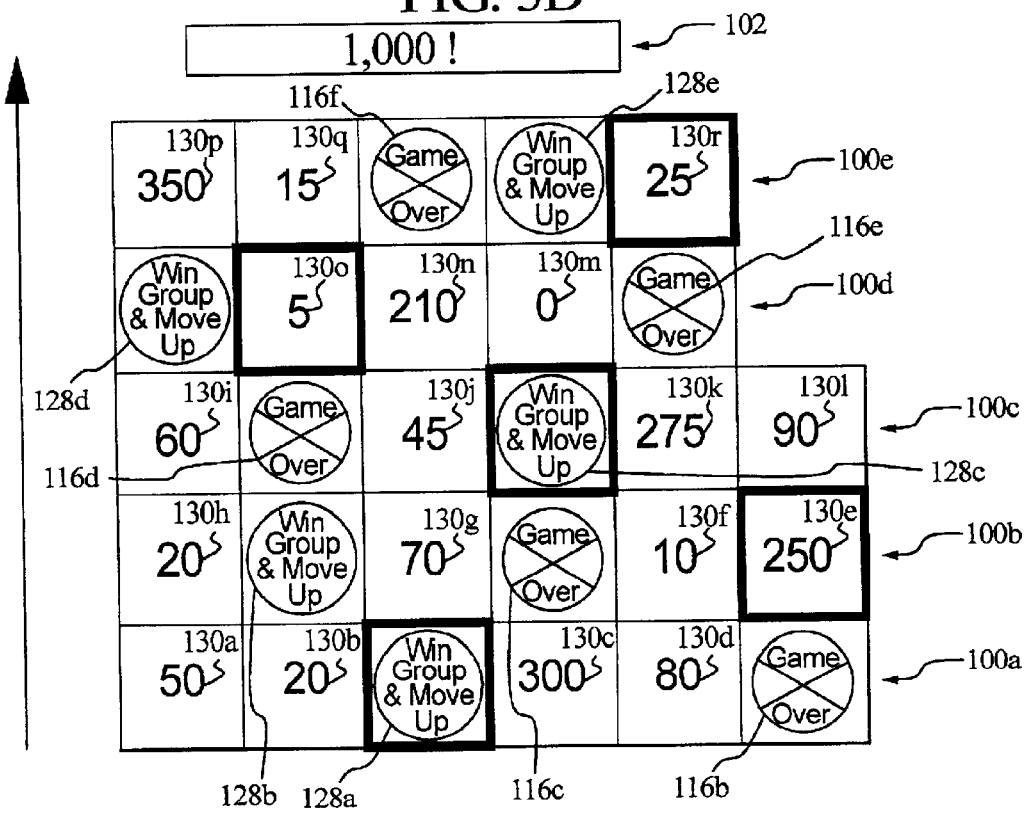

This result is further illustrated in FIG. 3D which illustrates a continuation of the example game of FIGS. 3A, 3B and 3C. After revealing the bonus value 130*e* which is 250 to the player, the game reveals the other bonus values 130*h*, 130*g* and 130*f* as well as the win group outcome 128*b* and the terminator outcome 116*c* in group 100*b*. The processor then enables the player to select one of the selections in group 100*c*. The player selects the selection which is associated with the win group outcome 128*c*. The processor provides the bonus awards 130*i* 130*j*, 130*k* and 130*l* to the player and reveals the terminator symbol 116*d*. The gaming device then enables the player to select one of the selections in group 100*d*. The player selects the blocked selection and the processor provides the bonus value 130*o* which is 5 to the player and reveals the bonus values 130*m*, 130*n*, the win group outcome 128*d* and the terminator symbol 116*e* associated with the other selections of group 100*d*. The processor then enables the player to select one of the selections in group 100*e*. The player selects the blocked selection having the bonus value 130*r* which is 25 associated therewith and the processor provides that award to the player. The processor also reveals the bonus value 130*p*, bonus value 130*q*, the terminator symbol 116*f* and the win group symbol 128*e* associated with the other selections in group 100*e*. Because the player selected a selection in each group without picking a selection which has an associated terminator, the processor reveals the achievement bonus award which is 1000 and provides that award to the player.

It should be appreciated that in the embodiment illustrated in FIGS. 3A to 3D only one terminator is associated with only one selection in each group. The chance of picking a terminator in groups 100*a*, 100*b* and 100*c* are 1 in 6. The chance of picking a terminator in groups 100*d* and 100*e* increase to 1 in 5. It should be appreciated that the number of terminator symbols associated with the selections in the groups may increase or change as desired by the game implementor. This will make it more difficult for the player to obtain the achievement bonus value. In one preferred embodiment, the number of terminating symbols associated with each group increases or the likelihood of obtaining a terminating symbol in each group increases. Accordingly, one embodiment of the present invention combines a plurality of selection groups which include a plurality of awards associated with the selections in the group, a plurality of terminator symbols associated with the selections in the groups, a win group outcome associated with the selections in the groups and an achievement bonus value associated with picking one selection in each group without obtaining a terminator.

A further embodiment of the present invention is illustrated in FIGS. 4 to 11. In this embodiment, first a bonus triggering event occurs as indicated by block 104. As indicated by block 106, the player then selects a symbol 110 in group 100*a*. The selection of symbols is emphasized in the figures by bolding the borders which surround the selected symbols. After the player's selection of symbol 110, the outcome associated with symbol 110 occurs, as indicated by block 108. Preferably, the processor dynamically generates the outcomes and associates them with symbols when the bonus triggering event occurs or following the player's selections.

Figure 6:
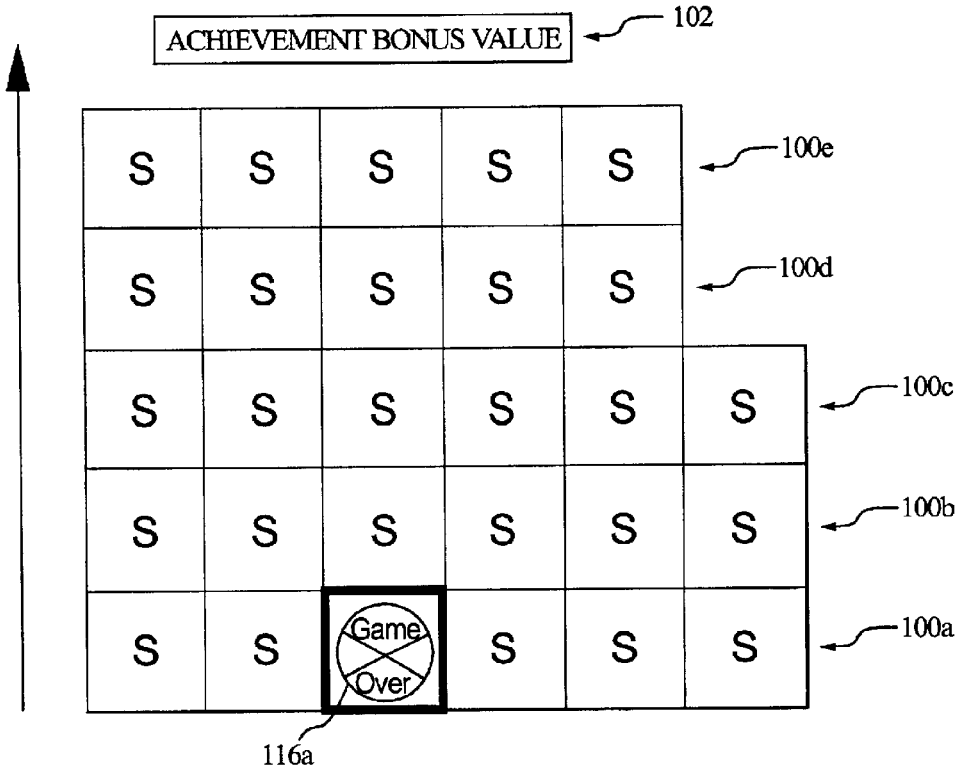
Figure 7:
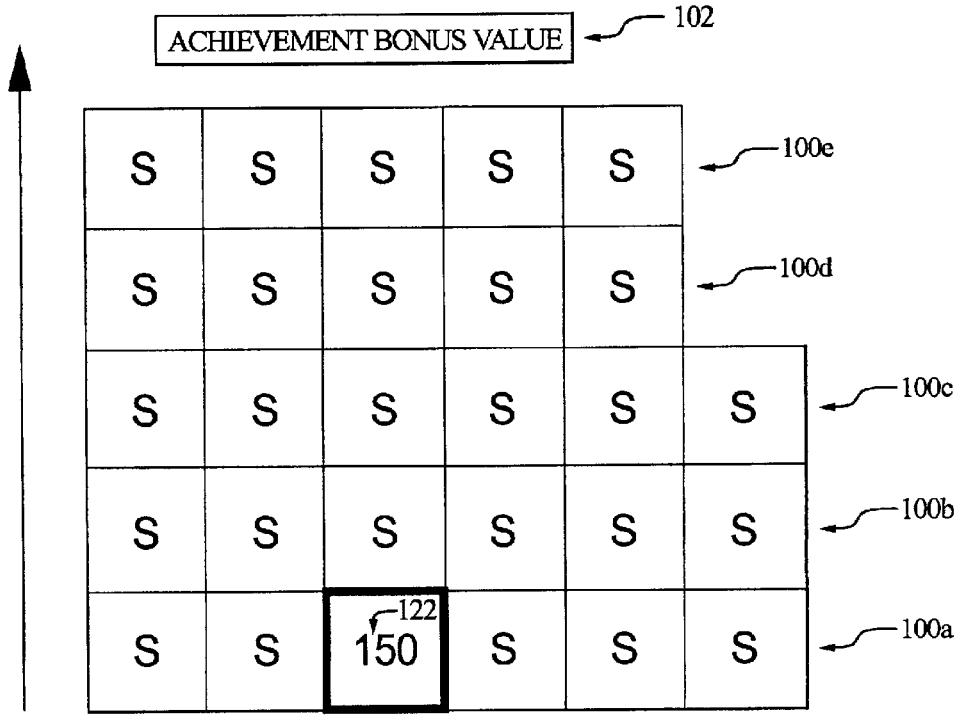
Figure 8:
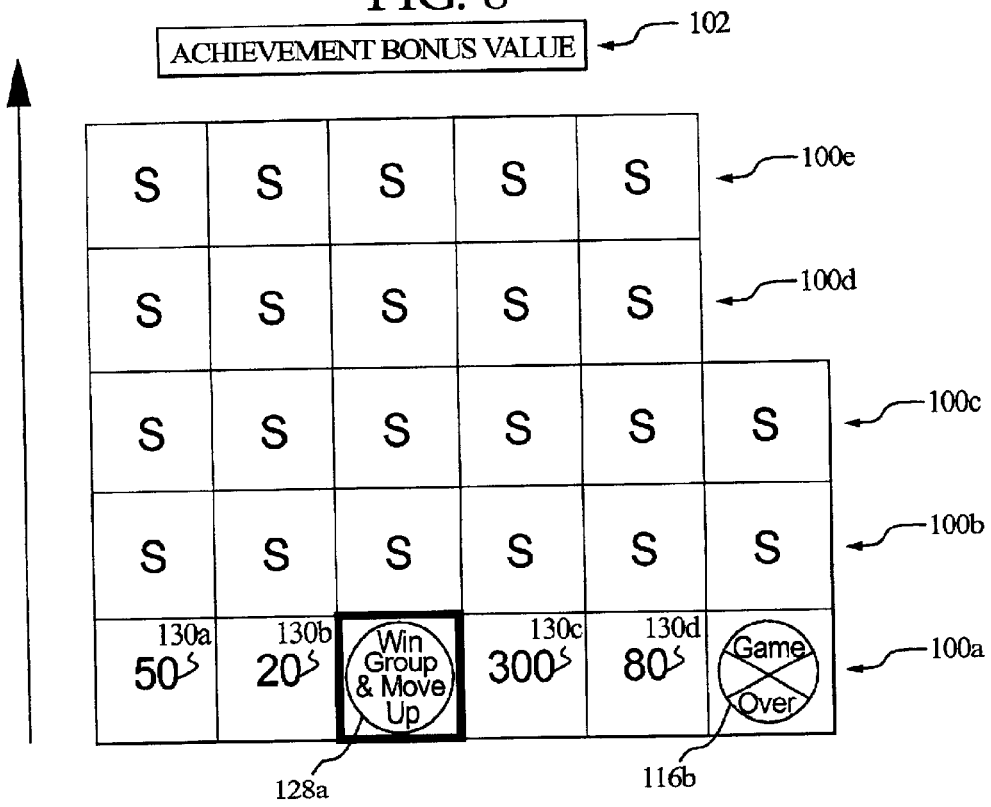

In any case, if a termination outcome is associated with the selected symbol 110, the bonus game terminates, as indicated by diamond 112 and block 114. Preferably, the gaming device indicates the termination outcome to the player with a terminator symbol 116*a*, as illustrated in FIG. 6. It should be appreciated that a consolation award could be provided to the player in association with a termination outcome. If a bonus value outcome is associated with the selected symbol 110, the processor provides the player with a predetermined bonus value, as indicated by diamond 118 and block 120. As illustrated in FIG. 7, preferably the gaming device indicates the bonus value outcome to the player with a bonus value 122 which is a numeral representative of a predetermined amount of bonus value credits. The processor then enables the player to select another symbol in the same group 100*a* until the player reaches a termination outcome or a win-group outcome, If a win-group outcome is associated with a symbol selected by the player, the processor provides the player with the bonus value outcomes associated with the win-group outcome, as indicated by block 124 and block 126. Preferably, the bonus value outcomes which are associated with the win-group outcome include all of the bonus value outcomes in the selected symbol's group. It is also preferable that the gaming device indicates the win-group outcome to the player with a win-group symbol 128*a*, as illustrated in FIG. 8. In addition, it is preferable that the gaming device indicates the associated bonus value outcomes with bonus values 130*a* to 130*d*.

Figure 4:
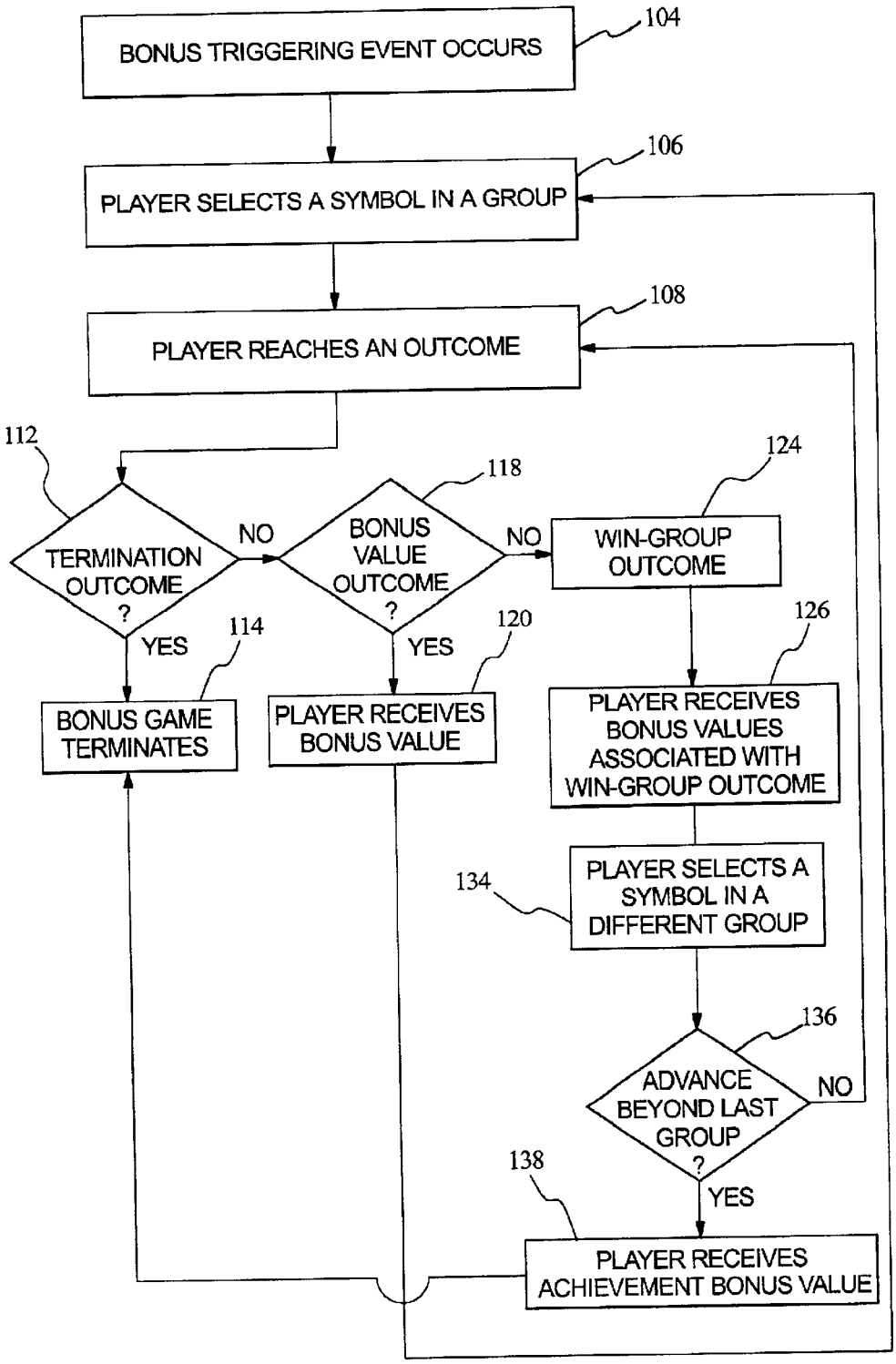
FIG. 4 is a flow diagram of one alternative embodiment of the present invention.
Figure 9:
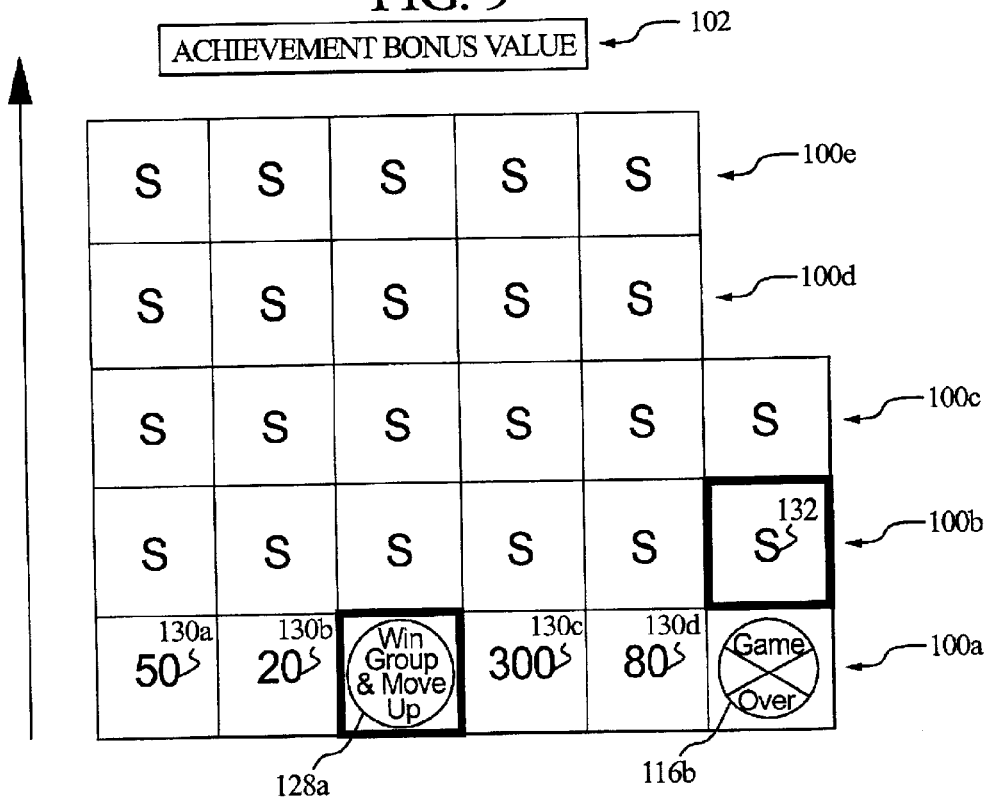
Figure 10:
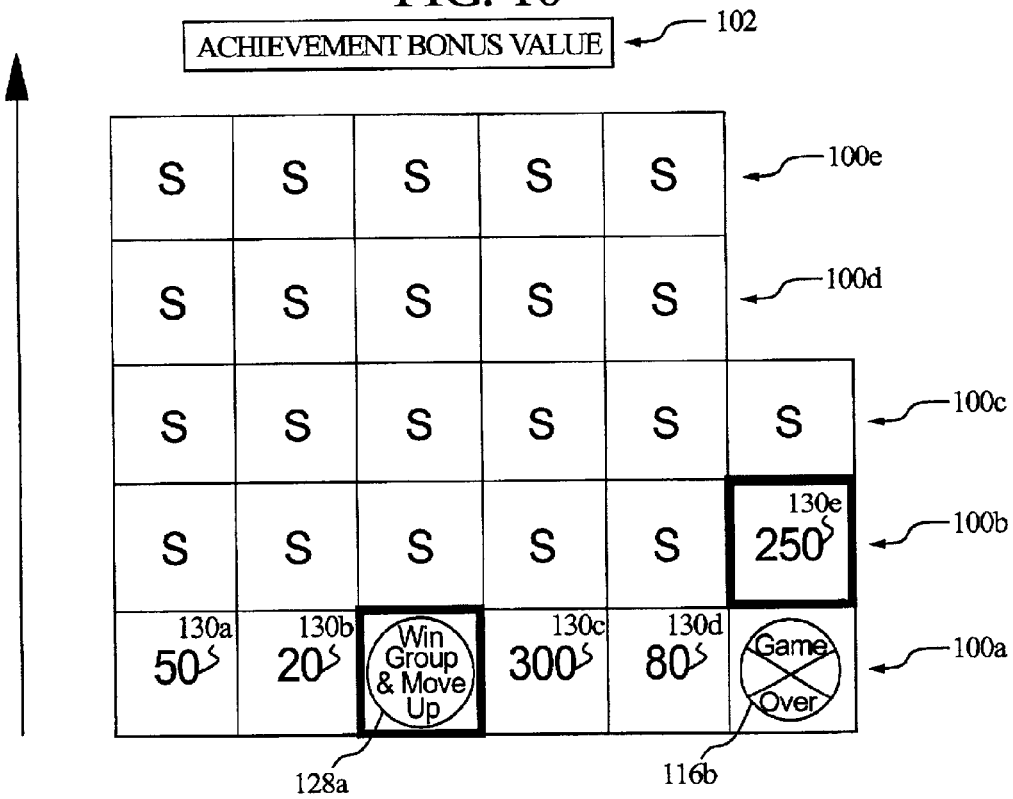

With reference to FIGS. 4, 9 and 10, at this point the processor advances or moves the player up to selection group 100*b* where the player can select a symbol 132 in that group, as indicated by block 134. In this example, the predetermined order in which the player can advance through selection groups is from bottom to top, as indicated by the arrows located to the left of the selection groups. An outcome occurs, such as a bonus value outcome indicated by bonus value 130*e*, and the entire selection process then repeats itself.

Figure 11:
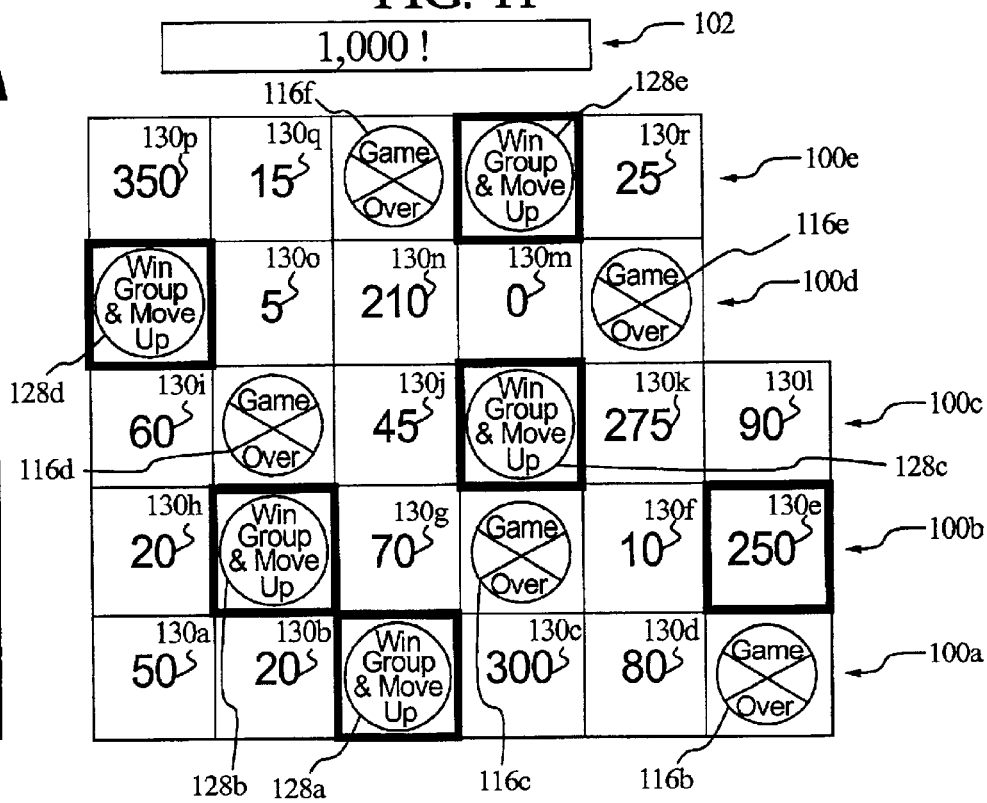

With reference to FIG. 11, as long as the player reaches the win-group outcomes (indicated by win-group symbols 128*b* to 128*e*) while avoiding the termination outcomes (indicated by terminator symbols 116*c* to 116*f*), the player will receive all of the bonus values 130*a* to 130*r* in all of the groups 100*a* to 100*e*. As indicated by diamond 136 and block 138 in FIG. 4, when the player reaches a win-group outcome in the last group without reaching a termination outcome, the player also receives the achievement bonus value 102. Achievement bonus value 102 is exemplified in FIG. 11 with a bonus credit amount of one thousand credits. The bonus game terminates when the player receives the achievement bonus value.

Figure 5:
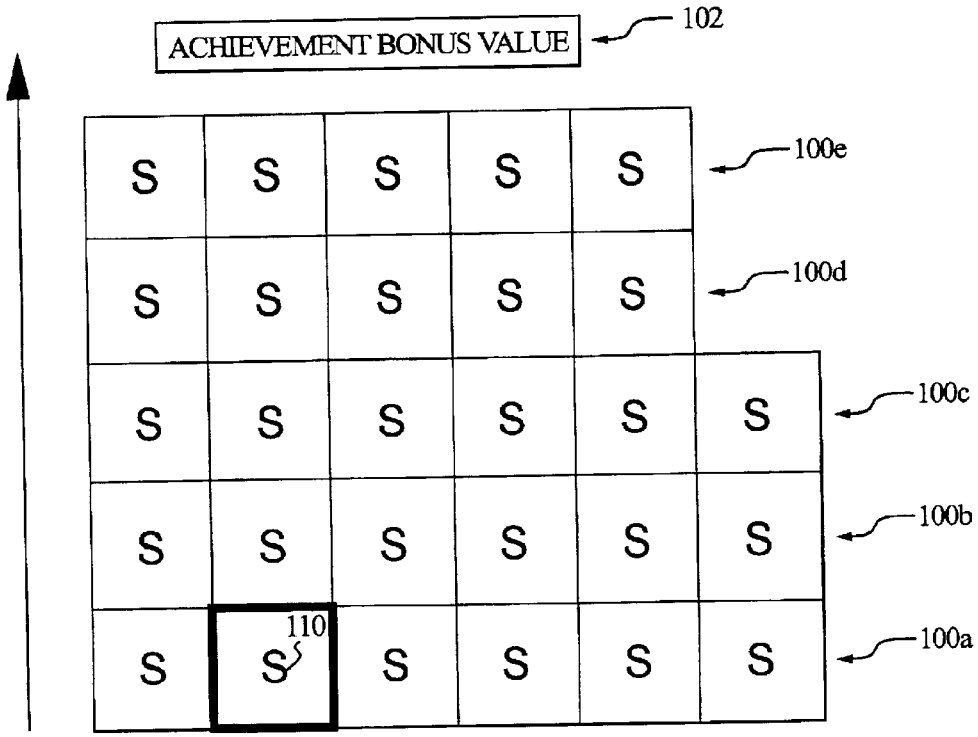
FIGS. 5 to 11 are top plan views of the selection groups in example bonus games in one alternative embodiment of the present invention.

It should be appreciated that when a player obtains a win-group outcome, in various embodiments the gaming device may provide various values associated with various symbols in a group. In one example, as illustrated in FIGS. 5 and 8, a player may pick symbol 110 and receive a win-group outcome associated with symbol 110. The gaming device may reveal values 130*a* to 130*d* and provide these values to the player. Alternatively, the gaming device may reveal values 130*a* to 130*c* and only provide these values to the player. It should also be appreciated that Instead of displaying win-group symbol 128*a*, the gaming device may reveal a value in place of symbol 110. The gaming device may provide this value to the player along with all other values associated with the win-group outcome.

In another example, a player may select the far left symbol in group 100*a* and receive value 130*a*. The player may then select the second symbol from the left in group 100*a* and receive value 130*b*. When the player selects symbol 110 and obtains the win-group outcome, the gaming device may provide the player only with values 130*c* and 130*d*, or the gaming device may provide the player with values 130*a* and 130*b* again, in addition to values 130*c* and 130*d*.

Figure 12:
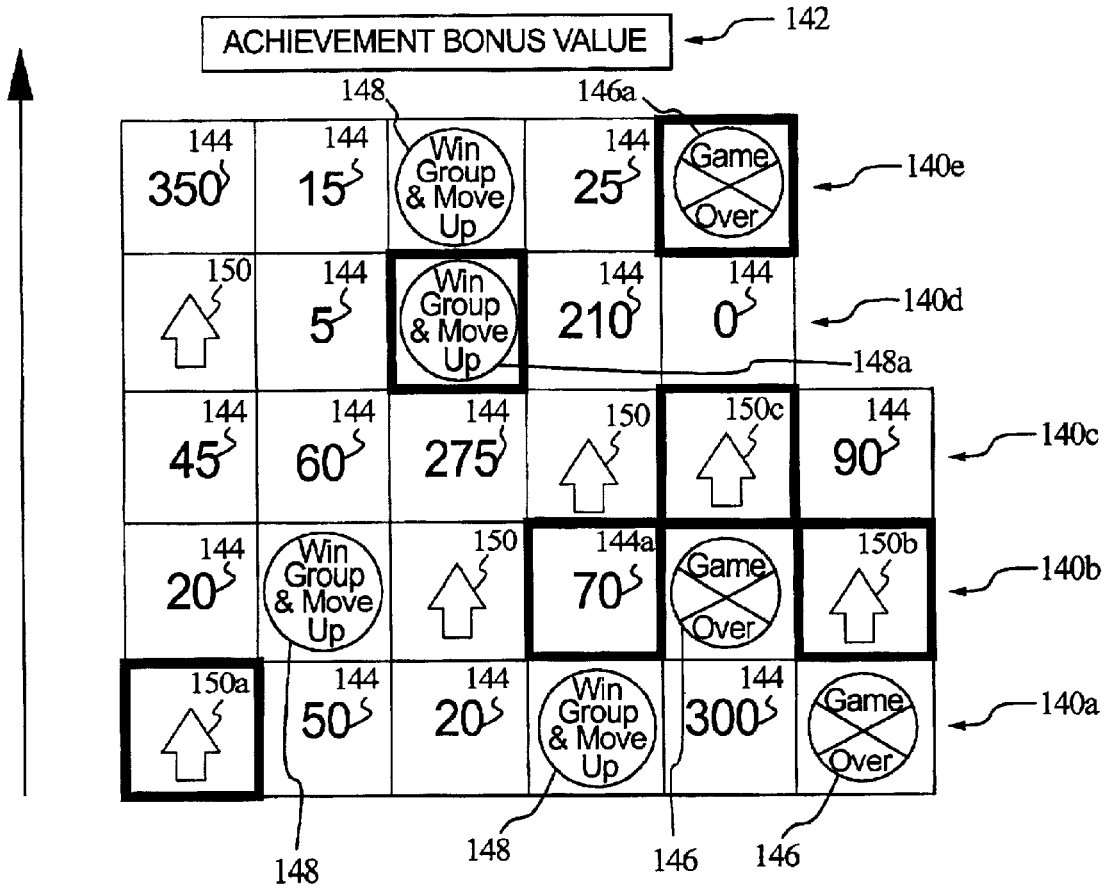
FIG. 12 is a top plan view of the selection groups in one example of one alternative embodiment of the bonus scheme of the present invention.

In another embodiment of the present invention illustrated in FIG. 12, the bonus scheme includes: (a) a plurality of selection groups 140*a* to 140*e*; (b) a plurality of selectable symbols (indicated by the capital letter "S") in each of the groups; (c) various bonus value outcomes associated with various symbols; (d) one or more termination outcomes associated with the symbols in each group; (e) one or more win-group outcomes associated with the symbols in each group; (f) one or more separate move outcomes associated with the symbols in each group; and (g) an achievement bonus value 142. If at any time a player reaches a move outcome in one group, the processor requires the player to make his/her next selection from a different group.

In an example bonus game of this embodiment, FIG. 12 illustrates various bonus values 144, terminator symbols 146, win-group symbols 148 and move symbols 150. In this example, the player can advance in a sequential group order from bottom to top, as indicated by the upwardly pointing arrow located to the left of the selection groups. The player initially selects a symbol (not shown) in group 140*a*, and the processor generates a move outcome and displays move symbol 150*a* in place of the selected symbol. The player receives no bonus values, and the processor requires the player to select his/her next symbol (not shown) from group 140*b*. The processor generates a bonus value outcome and displays bonus value 144*a* in place of the selected symbol. The player then receives the bonus value 144*a* of seventy credits. The player then selects another symbol (not shown) in group 140*b*, and the processor generates a move outcome and displays the move symbol 150*b* in place of the selected symbol. The processor requires the player to select his/her next symbol (not shown) in group 140*c*, resulting in a move outcome. The move outcome is indicated by move symbol 150*c* which replaces the selected symbol.

The processor enables the player to select his/her next symbol (not shown) in group 140*d*. This selection results in a win-group outcome which is indicated by win-group symbol 148*a* in place of the selected symbol. The player then receives all of the bonus values in group 140*d*. Next, the processor enables the player to select a symbol (not shown) in group 140*e*. The player's selection results in a termination outcome which is indicated by terminator symbol 146*a* displayed in place of the selected symbol. The bonus game then terminates and the player receives a payout equal to all of the bonus values gained.

It should be appreciated that in this embodiment, every group does not have to have a win-group outcome or a termination outcome associated with a selectable symbol in that group. For example, group 140*c* does not include any win-group outcomes or termination outcomes associated with any symbols in that group. This embodiment can also include move outcomes which require the player to revisit certain selection groups. For example, a player may advance to a predetermined group, select a symbol and receive a downward move outcome in that group. This type of move outcome could be indicated by a downwardly pointing move symbol (not shown). The player could then be required to make his/her next selection from a predetermined selection group located below the selected symbol's group.

Figure 13A:
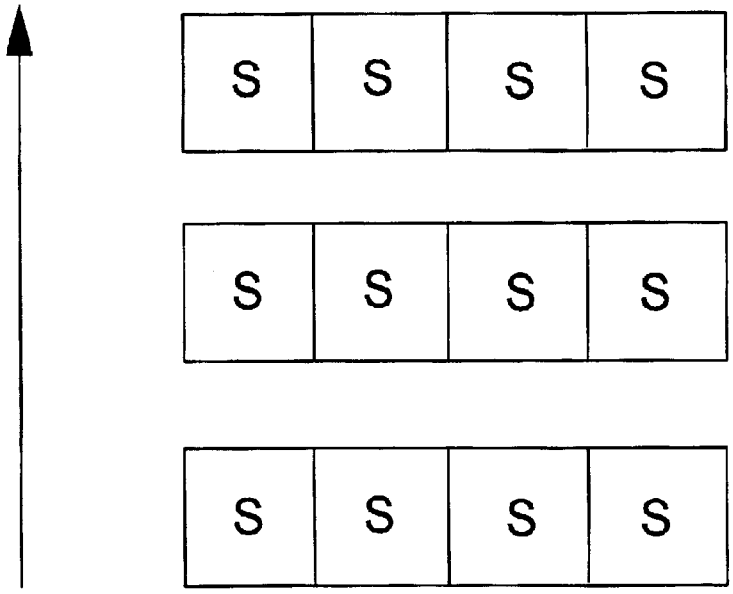
FIGS. 13A to 13C are top plan views of various selection group formations in various embodiments of the bonus scheme of the present invention.
Figure 13B:
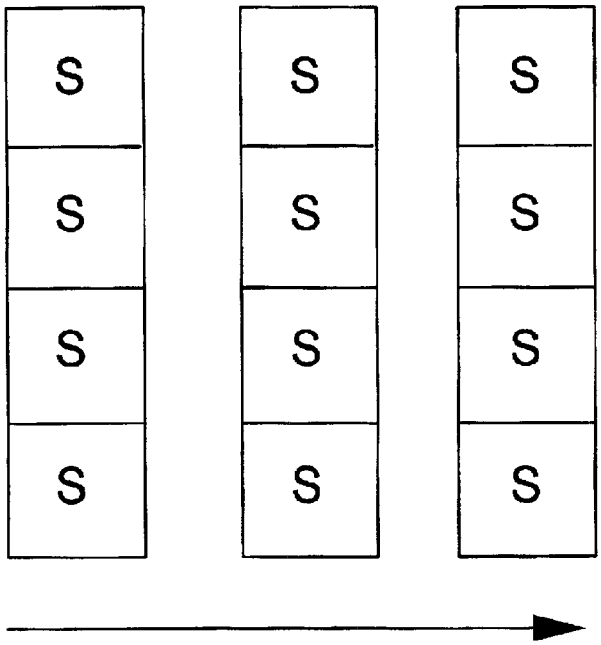
Figure 13C:
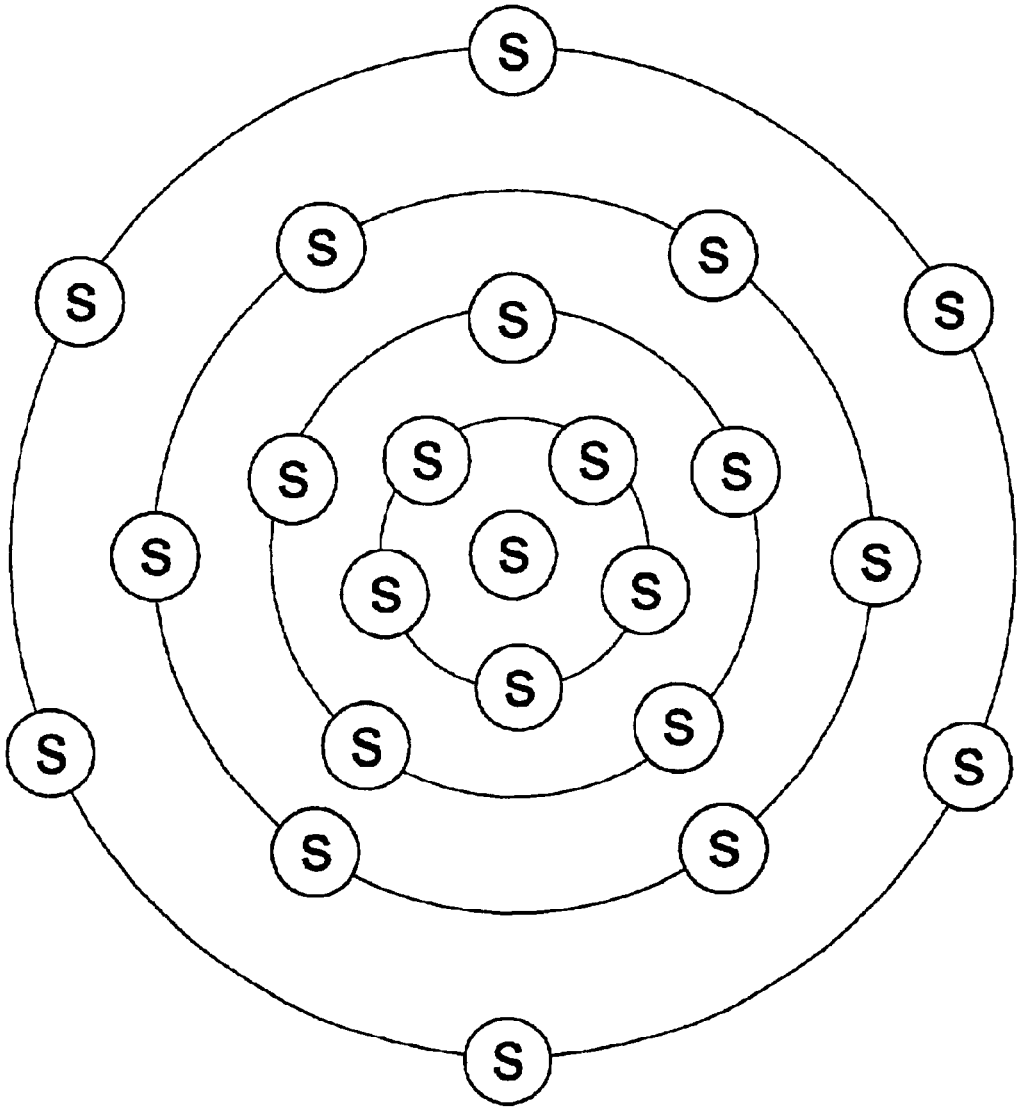

It should be appreciated that the selection groups in the present invention can have any form, shape or configuration, as illustrated in FIGS. 13A to 13C. Also, the predetermined order in which a player moves from group to group can vary as illustrated by the upwardly pointing arrow in FIG. 13A and the left to right pointing arrow in FIG. 13B. The move order can be sequential, non-sequential, orderly or disorderly. Further, it should be appreciated that the symbols shown in the figures herein are provided merely for illustrative purposes. The gaming device of the present invention can include or display any type of symbol or graphical image to represent selectable symbols, bonus values, win-group symbols, terminator symbols or move symbols.

In one alternative embodiment of the present invention, the bonus scheme includes win-group outcomes which do not advance the player to different groups. Here, when a player reaches a win-group outcome, the player receives all of the bonus values in the selected symbol's group, and the bonus game then terminates. In another alternative embodiment of the present invention, the processor does not reveal bonus values during the bonus game until the player reaches a win-group outcome or a termination outcome.

In another alternative embodiment, the present invention does not include a termination outcome associated with any of the selectable symbols in the selection groups. In this embodiment, the bonus game terminates when a predetermined termination condition occurs. The termination condition can be the player having made a predetermined number of selections or the player having received a predetermined bonus value amount. In this embodiment, the termination condition can apply to individual selection groups or to the entire bonus game. For example, the gaming device may terminate the bonus game if the player does not advance to a new selection group after making one selection in any single group.

In another alternative embodiment of the present invention, the win-group outcome is associated with a plurality of bonus values in a group but not all of the bonus values in that group. For example, in a selection group with six selectable symbols, four symbols in the group are each associated with a bonus value, one symbol is associated with a win-group outcome and one symbol is associated with a termination outcome. When a player selects the symbol associated with the win-group outcome, the player receives only two of the four bonus values in this selection group. Then the player advances to a different selection group to continue playing the bonus game.

The gaming device of the present invention accordingly provides a bonus game which enables a player to select symbols from a plurality of selection groups. In one embodiment, depending upon which symbol the player selects, the player may reach a bonus value outcome, a win-group outcome or a termination outcome which is associated with the selected symbols. If the player reaches a win-group outcome, the player wins all of the bonus value outcomes associated with all of the symbols in the selected symbol's group. Then the player advances to a different selection group and the process repeats itself. If the player advances beyond the final selection group without reaching a termination outcome, the player receives a predetermined achievement bonus value.

While the present invention has been described in connection with what is presently considered to be the most practical and preferred embodiments, it is to be understood that the invention is not limited to the disclosed embodiment, but on the contrary is intended to cover various modifications and equivalent arrangements included within the spirit and scope of the claim. It is thus to be understood that modifications and variations in the present invention may be made without departing from the novel aspects of this invention as defined in the claims and that this application is to be limited only by the scope of the claims.

What is claimed is:

1. A gaming device having a bonus game comprising:

a plurality of groups of symbols;

a plurality of bonus values associated with the symbols;

at least one win-group outcome associated with at least one of the symbols in at least one of the groups, the win-group outcome including a change group outcome and a plurality of the bonus values in said group;

at least one termination outcome associated with at least one of the symbols in at least one of the groups;

an achievement outcome;

a display device which displays the symbols; and a processor in communication with the display device, which: (a) enables a player to select at least one symbol in one of said groups; (b) provides the player with any bonus values associated with the selected symbol; (c) provides the player with the win-group outcome if the player picks the symbol including said win-group outcome; (d) changes to another of said groups of symbols based on the change group outcome associated with said win-group outcome and repeats (a) to (d) for said another group if the player picks the symbol including said win-group outcome; (e) terminates the bonus game if the player picks any symbol having the termination outcome; and (f) provides the player with the achievement outcome if the player picks at least one symbol in each of said groups without picking any symbol having the termination outcome.

2. The gaming device of claim 1, which includes a win-group outcome associated with at least one of the symbols in a plurality of the groups.

3. The gaming device of claim 1, which includes a win-group outcome associated with at least one of the symbols in each of the groups.

4. The gaming device of claim 1, wherein the win-group outcome includes all of the bonus values associated with the symbols in said group.

5. The gaming device of claim 1, wherein the win-group outcome includes all of the bonus values associated with the symbols in said group not previously selected by the player.

6. The gaming device of claim 1, which include a termination outcome associated with at least one of the symbols in a plurality of the groups.

7. The gaming device of claim 1, which include a termination outcome associated with at least one of the symbols in each of the groups.

8. A gaming device having a bonus game comprising:

a plurality of groups of symbols;

a plurality of bonus values associated with the symbols;

at least one win-group outcome associated with at least one of the symbols in at least one of the groups, the win-group outcome including a change group outcome and a plurality of the bonus values associated with the symbols in said group;

at least one termination outcome associated with at least one of the symbols in at least one of the groups;

a display device which displays the symbols; and a processor in communication with the display device, which: (a) enables a player to select at least one symbol in one of said groups; (b) provides the player with any bonus values associated with the selected symbols; (c) provides the player with the win-group outcome if the player picks the symbol including said win-group outcome; (d) changes to another of said groups of symbols based on the change group outcome associated with said win-group outcome and repeats (a) to (d) for said another group if the player picks the symbol including said win-group outcome; and (e) terminates the bonus game if the termination outcome is associated with one of the selected symbols.

9. The gaming device of claim 8, which includes a termination outcome associated with at least one of the symbols in a plurality of the groups.

10. The gaming device of claim 9, which includes an achievement award provided to the player if the player selects at least one symbol in each group without selecting one of the symbols having an associated termination outcome.

11. The gaming device of claim 8, which includes a termination outcome associated with at least one of the symbols in each of the groups.

12. The gaming device of claim 11, which includes an achievement award provided to the player if the player selects at least one symbol in each group without selecting one of the symbols having an associated termination outcome.

13. A gaming device having a bonus game comprising:

a plurality of groups of symbols;

a plurality of bonus values associated with the symbols;

at least one win-group outcome associated with at least one of the symbols in at least one of the groups, the win-group outcome including a change group outcome and a plurality of the bonus values in said group;

at least one separate change group outcome associated with at least one of the symbols in at least one of the groups;

a display device which displays the symbols; and a processor in communication with the display device, which: (a) enables a player to select at least one symbol in one of said groups; (b) provides the player with the bonus values associated with the selected symbols; (c) provides the player with the win-group outcome if the player picks the symbol including said win-group outcome; (d) changes to another of said groups of symbols based on the change group outcome associated with said win-group outcome and repeats (a) to (d) for said another group if the player picks the symbol including said win-group outcome; (e) changes to another of said groups of symbols based on the change group outcome associated with at least one of the symbols and repeats (a) to (d) for said another group when the separate change group outcome is associated with the selected symbol; and (f) terminates the bonus game if a termination outcome associated with the selected symbol occurs.

14. The gaming device of claim 13, wherein a separate change group outcome is associated with at least one of the symbols in a plurality of the groups.

15. A gaming device having a bonus game comprising:

a plurality of groups of symbols;

a plurality of bonus values associated with the symbols;

at least one win-group outcome associated with at least one of the symbols in at least one of the groups, the win-group including a change group outcome and a plurality of the bonus values in said group;

a termination outcome associated with the symbols or bonus values associated with the symbols in at least one group;

a memory device which stores the bonus values, the win-group outcomes and the termination outcome;

a display device which displays the symbols; and a processor in communication with the memory device and the display device, which: (a) enables a player to select at least one symbol in one of the groups; (b) provides the player with the bonus values associated with the selected symbols; (c) provides the player with the win-group outcome if the player picks the symbol including said win-group outcome; (d) changes to another one of said groups of symbols based on the change group outcome associated with said win-group outcome and repeats (a) to (d) for said another group if the player picks the symbol including said win-group outcome; and (e) terminates the bonus game when said termination outcome occurs.

16. The gaming device of claim 15, wherein the termination outcome is a predetermined number of symbols selected by the player.

17. The gaming device of claim 15, wherein the termination outcome is a predetermined total accumulation of bonus values provided to the player.

18. A gaming device having a bonus game comprising:

a plurality of groups of symbols;

a plurality of bonus values associated with the symbols;

at least one win-group outcome associated with at least one of the symbols in at least one of the groups, the win-group outcome including a plurality of the bonus values associated with the symbols in said group;

a display device which displays the symbols; and a processor in communication with the display device, which: (a) enables a player to select symbols in said groups; (b) provides the player with the bonus values associated with the selected symbols; (c) provides the player with the win-group outcome and terminates the bonus game when the win-group outcome is associated with a selected symbol.

19. The gaming device of claim 18, wherein the processor displays the bonus values associated with a selected symbol after the processor determines that the selected symbol is associated with a win-group symbol.

20. The gaming device of claim 18, which includes an additional award provided to the player if the player selects at least one symbol in each group without selecting one of the symbols having a win-group outcome.

21. A gaming device having a bonus game comprising:

a plurality of selection groups;

a plurality of symbols in each selection group;

a plurality of bonus values associated with the symbols in each selection group;

at least one win-group outcome associated with one of the symbols in each selection group, wherein each win-group outcome includes a change group outcome and at least one of the bonus values associated with the symbols in each selection group;

an achievement bonus value;

a display device which displays the selection groups and the symbols; and a processor in communication with the display device, which: (a) enables a player to select at least one symbol in one of said groups; (b) provides the player with the bonus values associated with the selected symbols; c) provides the player with the win-group outcome if the player picks the symbol including said win-group outcome; (d) changes to another of said selection groups based on the change group outcome associated with said win-group outcome and repeats (a) to (d) for said another selection group if the player picks the symbol including said win-group outcome; and (e) provides the achievement bonus value to the player if the player selects at least one symbol in each of said selection groups without obtaining a termination outcome in said bonus game.

22. The gaming device of claim 21, wherein the win-group outcome in each selection group include all of the bonus values associated with the symbols in said selection group.

23. The gaming device of claim 21, wherein the win-group outcome in each selection group includes the bonus values associated with the symbols in said selection group not previously provided to the player.

24. A gaming device having a bonus game comprising:

a plurality of selection groups;

a plurality of symbols in each selection group;

a plurality of bonus values associated with the symbols in each selection group;

at least one win-group outcome associated with one of the symbols in each selection group, wherein each win-group outcome in each selection group includes a change group outcome and all of the bonus values associated with the symbols in said selection group;

at least one termination outcome associated with one of the symbols in each selection group;

a display device which displays the selection groups and the symbols; and a processor in communication with the display device, which: (a) enables a player to select at least one symbol in one of said selection groups; (b) provides the player with any bonus values associated with the selected symbols; (c) provides the player with the win-group outcome if the player picks the symbol including said win-group outcome; (d) changes to another of said selection groups based on the change group outcome associated with said win-group outcome and repeats (a) to (d) for said another selection group if the player picks the symbol including said win-group outcome; and (e) terminates the bonus game if said termination outcome is associated with one of the selected symbols.

25. A method of providing a bonus game in a gaming device, said method comprising the steps of:

(a) triggering a bonus game;

(b) displaying a plurality of groups of symbols to a player;

(c) associating a plurality of bonus values with the symbols; (d) associating at least one win-group outcome with at least one of the symbols in at least one of the groups;

(e) associating a change group outcome and a plurality of the bonus values in said group with the win-group outcome;

(f) enabling the player to select at least one symbol in one of said groups;

(g) providing the player with said bonus values associated with the selected symbols;

(h) providing the player with any win-group outcome associated with the selected symbol if the player picks the symbol including said win-group outcome;

(i) changing to another of said groups of symbols based on the change group outcome associated with said win-group outcome if the player picks the symbol including said win-group outcome;

(j) repeating steps (a) to (i) until the player picks a symbol having an associated terminator; and (k) providing an achievement bonus to the player if the player picks one of the symbols in each of said groups without selecting symbol having an associated terminator in any group.

26. The method of claim 25, which includes the step of associating the win-group outcome with all of the bonus values which are associated with symbols in said group.

27. The method of claim 25, which includes operating the gaming device through a data network.

28. The method of claim 27, wherein the data network is an internet.

29. A gaming device having a bonus game comprising:

a plurality of groups of symbols;

a plurality of bonus values associated with the symbols;

at least one win-group outcome associated with at least one of the symbols in at least one of the groups, the win-group including a plurality of the bonus values in said group;

a termination outcome associated with at least one of the symbols or bonus values associated with the symbols in at least one group, wherein the termination outcome is a predetermined total accumulation of bonus values provided to the player;

a memory device which stores the bonus values, the win-group outcomes and the termination outcome;

a display device which displays the symbols; and a processor in communication with the memory device and the display device, which: (a) enables a player to select at least one symbol in each of the groups; (b) provides the player with any bonus values associated with the selected symbols; (c) provides the player with the win-group outcome if the player picks the symbol including said win-group outcome; (d) terminates the bonus game when said termination outcome occurs; and (e) provides an additional award to the player when the player selects at least one symbol in each of the groups without selecting one of the symbols associated with the termination outcome.

30. The gaming device of claim 29, wherein the win-group outcome includes all of the bonus values associated with the symbols in said group.

31. The gaming device of claim 29, wherein the win-group outcome includes all of the bonus values associated with the symbols in said group not previously selected by the player.

32. The gaming device of claim 29, wherein a separate change group outcome is associated with at least one of the symbols in a plurality of the groups.

33. A method of providing a bonus game in a gaming device, said method comprising the steps of:

(a) triggering a bonus game;

(b) displaying a plurality of groups of symbols to a player;

(c) associating a plurality of bonus values with the symbols;

(d) associating at least one win-group outcome with at least one of the symbols in at least one of the groups;

(e) associating a plurality of the bonus values in said group with the win-group outcome;

(f) enabling the player to select symbols in said groups;

(g) providing the player with said bonus values associated with the selected symbols;

(h) providing the player with the win-group outcome associated with the selected symbol when the player picks the symbol including said win-group outcome; and (i) terminating the bonus game when any win-group outcome are associated with a selected symbol.

34. The method of claim 33, which includes displaying the bonus values associated with a selected symbol after determining that the selected symbol is associated with a win-group symbol.

35. The method of claim 33, which includes providing a additional award to the player if the player selects at least one symbol in each group without selecting one of the symbols having a win-group outcome.

36. The method of claim 33, which includes operating the gaming device through a data network.

37. The method of claim 36, wherein the data network is an internet.

* * * * *